US009353743B2

(12) United States Patent
Ehrhardt et al.

(10) Patent No.: US 9,353,743 B2
(45) **Date of Patent: *May 31, 2016**

(54) FIXED AND VARIABLE PUMPS WITH PARALLEL FLOW

(71) Applicant: Dr. Ing. h.c. F. Porsche Aktiengesellschaft, Stuttgart (DE)

(72) Inventors: Jens Ehrhardt, Eberdingen (DE); Andreas Misala, Sachsenheim (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/132,773

(22) Filed: Dec. 18, 2013

(65) Prior Publication Data

US 2014/0178230 A1 Jun. 26, 2014

(30) Foreign Application Priority Data

Dec. 20, 2012 (DE) ..... 10 2012 112 720

(51) Int. Cl.

| | |
|---|---|
| ***F04C 11/00*** | (2006.01) |
| ***F04C 14/04*** | (2006.01) |
| ***F04C 2/18*** | (2006.01) |
| ***F04C 2/344*** | (2006.01) |
| ***F04C 14/22*** | (2006.01) |

(52) U.S. Cl.

CPC ..... *F04C 11/005* (2013.01); *F04C 14/04* (2013.01); *F04C 2/18* (2013.01); *F04C 2/344* (2013.01); *F04C 14/226* (2013.01)

(58) Field of Classification Search

CPC .. F04B 43/025; F04B 43/0736; F04C 11/005; F04C 14/04

USPC ..... 418/3, 24, 27, 29, 30, 31, 210, 211, 418/213, 215, 217

See application file for complete search history.

(56) References Cited

U.S. PATENT DOCUMENTS

| | | | | |
|---|---|---|---|---|
| 2,988,889 | A * | 6/1961 | Bookout et al. | 60/419 |
| 3,038,312 | A * | 6/1962 | Marsh | 418/25 |
| 3,077,840 | A * | 2/1963 | Wood | F01C 21/02 418/206.9 |
| 4,077,211 | A * | 3/1978 | Fricke | 60/428 |
| 4,538,966 | A * | 9/1985 | Nikaido | 418/102 |
| 4,586,468 | A * | 5/1986 | Dzioba | 418/3 |

(Continued)

FOREIGN PATENT DOCUMENTS

| | | |
|---|---|---|
| CN | 2204871 | 8/1995 |
| DE | 103 37 653 A1 | 3/2005 |

(Continued)

OTHER PUBLICATIONS

Search Report DE 10 2012 112 720.4 dated Aug. 27, 2013 with partial English translation.

(Continued)

*Primary Examiner* — Mary A Davis
(74) *Attorney, Agent, or Firm* — RatnerPrestia

(57) ABSTRACT

A pump (1, 10) having a housing (15) with a suction-side fluid inlet (4) and with a pressure-side fluid outlet (5), having a first pump unit (2, 11) and having a second pump unit (3, 12), the first pump unit (2, 11) being connected hydraulically in parallel with respect to the second pump unit (3, 12), wherein the first pump unit (2, 11) is a pump unit that exhibits a constant volume flow, wherein the second pump unit (3, 12) is a pump unit that exhibits variably adjustable volume flow.

11 Claims, 8 Drawing Sheets

(56) References Cited

U.S. PATENT DOCUMENTS

| | | | | |
|---|---|---|---|---|
| 4,716,726 | A * | 1/1988 | Nowaczyk | 418/30 |
| 6,126,420 | A * | 10/2000 | Eisenmann | 418/31 |
| 6,174,144 | B1 | 1/2001 | van Hamme et al. | |
| 6,454,543 | B1 * | 9/2002 | Beck et al. | 417/199.1 |
| 6,537,047 | B2 * | 3/2003 | Walker | 418/30 |
| 6,579,070 | B1 * | 6/2003 | Birkenmaier et al. | 418/3 |
| 6,588,207 | B1 * | 7/2003 | Pouliot | 418/201.3 |
| 7,056,101 | B1 * | 6/2006 | Hauser et al. | 417/269 |
| 7,108,493 | B2 * | 9/2006 | Clements et al. | 418/30 |
| 8,113,803 | B2 | 2/2012 | Colombo et al. | |
| 8,231,359 | B2 | 7/2012 | Merz et al. | |
| 8,287,255 | B2 * | 10/2012 | Yokoi et al. | 417/426 |
| 2008/0193301 | A1 * | 8/2008 | Fujii et al. | 418/3 |
| 2013/0022485 | A1 * | 1/2013 | Hunter et al. | 418/3 |
| 2014/0094727 | A1 | 4/2014 | Deshpande | |
| 2014/0158345 | A1 * | 6/2014 | Jang et al. | 166/250.1 |
| 2014/0178231 | A1 * | 6/2014 | Ehrhardt et al. | 418/3 |

FOREIGN PATENT DOCUMENTS

| | | |
|---|---|---|
| DE | 10 2007 032 103 A1 | 11/2008 |
| WO | 02077451 | 10/2002 |

OTHER PUBLICATIONS

Non-Final Office Action for U.S. Appl. No. 14/132,785 dated Oct. 23, 2014.

Non-Final Office Action for U.S. Appl. No. 14/132,785 dated May 15, 2015.

Final Office Action mailed Nov. 2, 2015 in U.S. Appl. No. 14/132,785.

Chinese Office Action mailed Sep. 6, 2015 for Chinese Application No. 201310711875.8, including English translation.

* cited by examiner

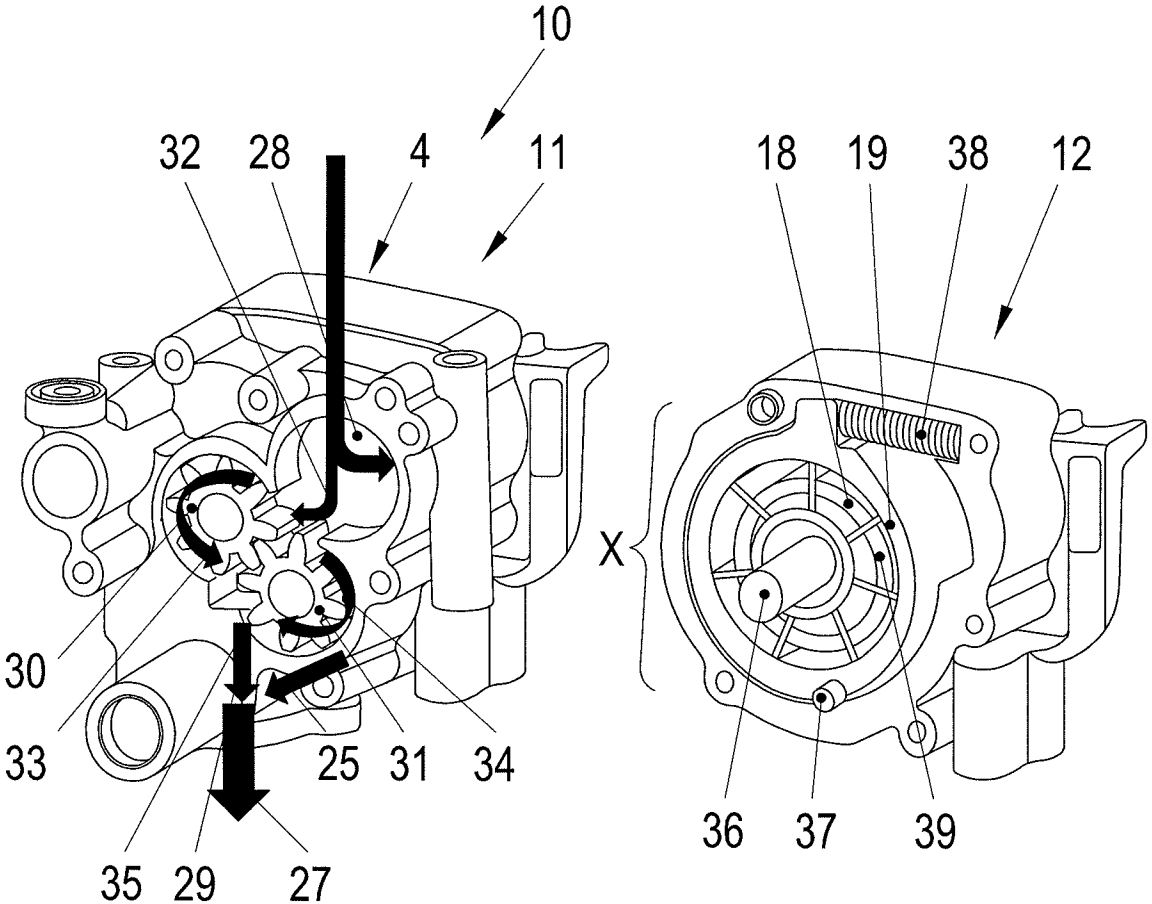
Fig. 4
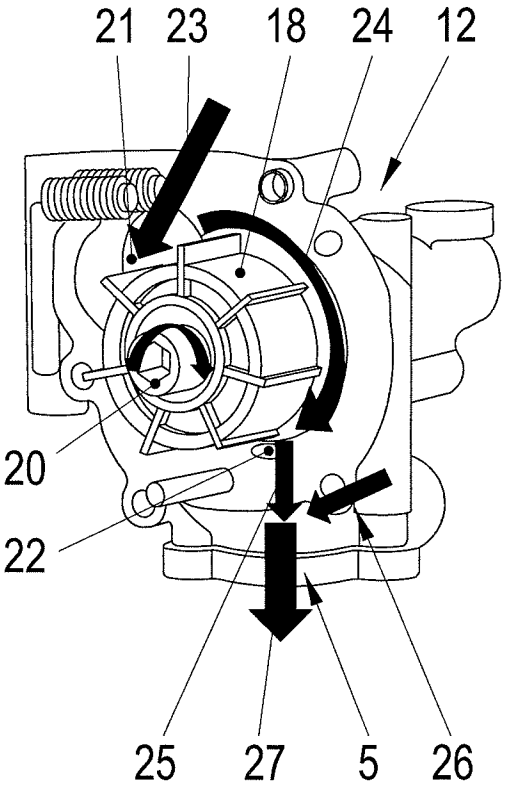
Fig. 3
Fig. 5

FIXED AND VARIABLE PUMPS WITH PARALLEL FLOW

CROSS-REFERENCE TO RELATED APPLICATIONS

This application claims priority of German Patent Application No. 10 2012 112 720.4, filed Dec. 20, 2012, which is incorporated by reference herein in its entirety.

FIELD OF INVENTION

The invention relates to a pump, in particular for an oil supply of a motor vehicle.

BACKGROUND

In motor vehicles in particular, pumps are used for a variety of purposes. For example, an oil pump is used to ensure an oil supply, for example for the lubrication of the internal combustion engine or of the transmission.

Here, use is often made of a pump that exhibits a constant volume flow, which pump generates a volume flow that can satisfy the maximum and minimum conditions.

If said pumps are driven by the internal combustion engine for example via a belt drive, the rotational speed of the drive of the pump also varies, such that the minimum demands on the volume flow must be satisfied at the lowest rotational speed, whereas at high rotational speeds, the maximum volume flow must be attained in order to realize the volume flows required in this operating situation.

In the case of constant drive rotational speed, however, the volume flow cannot be adjusted.

If use is made of a fully variable vane-type pump, the stop for the minimum delivery volume flow is selected such that a minimum delivery is ensured, because a minimum delivery volume flow is always required since this is required for pressure generation.

If said pump is supplemented by a gearwheel pump connected in parallel, said gearwheel pump assists in the delivery of the volume. During cold operation, however, more fluid is delivered than is required by the internal combustion engine of the vehicle in order to attain the demanded pressure. This would, in the case of cold temperatures, result in the fluid pressure, for example oil pressure, being higher than required, which would have a disadvantageous effect on the drive power and exhaust-gas emissions. Furthermore, a cut-off valve would have to be designed for the conditions during continuous operation, because it has the task of limiting the pressure not only during starting operation when the engine is cold but also at high engine speeds under cold conditions. This is however disadvantageous and expensive for the configuration of the valve.

It is therefore the object of the present invention to provide a pump by means of which a variable oil supply can be ensured, wherein the pump should nevertheless be of simple and inexpensive construction.

SUMMARY

The object is achieved by means of a pump having a housing with a suction-side fluid inlet and with a pressure-side fluid outlet, having a first pump unit and having a second pump unit, the first pump unit being connected hydraulically in parallel with respect to the second pump unit, wherein the first pump unit is a pump unit that exhibits a constant volume flow, wherein the second pump unit is a pump unit that exhibits variably adjustable volume flow.

An exemplary embodiment of the invention relates to a pump having a housing with a suction-side fluid inlet and with a pressure-side fluid outlet, having a first pump unit and having a second pump unit, the first pump unit being connected hydraulically in parallel with respect to the second pump unit, wherein the first pump unit is a pump unit that exhibits a constant volume flow, wherein the second pump unit is a pump unit that exhibits variably adjustable volume flow. Here, a pump unit with a constant volume flow is a pump unit that also delivers a constant volume flow in the case of a fixed drive rotational speed. Here, a pump unit with variable volume flow is a pump unit which, in the case of a constant drive rotational speed, is nevertheless variably adjustable and permits a variable volume flow. Such a pump unit makes it possible, in parallel with a constant volume flow, for said constant volume flow to be modulated by means of the second pump unit. It is particularly advantageous if the second pump unit also makes it possible to set a negative volume flow, such that the constant volume flow of the first pump unit can correspondingly also be reduced.

It is advantageous here if the first pump unit and the second pump unit can be driven by at least one drive element. It is particularly advantageous if the first pump unit and the second pump unit can be driven by the same drive unit. Here, a drive unit may be an electric motor, a hydraulic motor or a belt-pulley drive. The drive unit may also be a direct drive connection, transmitted via a gearing, to a motor element, for example to the internal combustion engine or the like.

It is also advantageous here if the first pump unit exhibits a constant volume flow in the case of a constant drive rotational speed of the drive element.

It is also expedient if the second pump unit exhibits a variably adjustable volume flow in the case of a constant drive rotational speed of the drive element.

Here, it is particularly advantageous if the variably adjustable volume flow of the second pump unit can be adjusted from positive volume flow values to zero.

It is also particularly expedient if the variably adjustable volume flow of the second pump unit can be adjusted from positive volume flow values to negative volume flow values, with the volume flow being reversed. As a result, the volume flow of the first pump unit can be reduced by the negative volume flow.

It is also expedient if the first pump unit is a gearwheel pump, such as in particular an external gearwheel pump or an internal gearwheel pump.

It is furthermore expedient if the second pump unit is a vane-type pump. Here, the second pump unit may be a vane-type pump with variable delivery volume flow. The second pump unit may alternatively be a pendulum slide pump.

It is particularly advantageous if the first pump unit and the second pump unit have in each case one inlet duct and one outlet duct that are connected to one another, wherein the inlet duct of the second pump unit becomes the outlet duct in the event of a volume flow reversal, and wherein the outlet duct of the second pump unit becomes the inlet duct in the event of a volume flow reversal, such that, in the event of a volume flow reversal, the inlet duct of the first pump unit is connected to the outlet duct of the second pump unit and the outlet duct of the first pump unit is connected to the inlet duct of the second pump unit.

BRIEF DESCRIPTION OF THE DRAWINGS

The invention will be explained in detail below on the basis of an exemplary embodiment and with reference to the drawing, in which:

FIG. 3 is a schematic illustration of a pump according to the invention in a perspective partial view, FIG. 4 is a schematic illustration of a pump according to the invention in a perspective partial view, FIG. 5 is a schematic illustration of a pump according to the invention in a perspective partial view.

DETAILED DESCRIPTION

Figure 1:
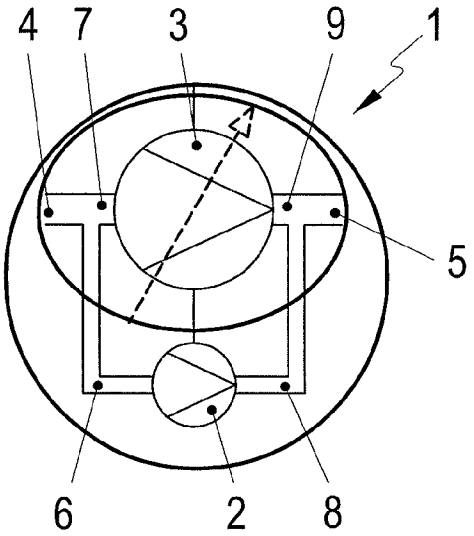
FIG. 1 is a schematic illustration of a pump according to the invention.

FIG. 1 shows a circuit diagram of a pump 1 having a first pump unit 2 and having a second pump unit 3. The pump 1 has a suction-side fluid inlet 4 and a pressure-side fluid outlet 5. The two pump units, that is to say the first pump unit 2 and the second pump unit 3 are arranged and connected hydraulically in parallel with respect to one another. The first pump unit 2 is a pump unit that exhibits a constant volume flow, and the second pump unit 3 is a pump unit that exhibits variably adjustable volume flow.

A pump unit that exhibits a constant volume flow is a pump unit in which a constant drive rotational speed of a drive element results in a constant volume flow. Here, the volume flow may nevertheless also be variable in the case of a variable drive rotational speed of the drive element.

A pump unit that exhibits variably adjustable volume flow is a pump unit with which, in the case of a constant drive rotational speed of a drive element, a variably adjustable volume flow can be controlled. Here, the volume flow may in turn also be variable in the case of a variable drive rotational speed of the drive element. It is particularly preferable here for the variably adjustable volume flow of the second pump unit 3 to be adjustable such that it can be adjusted or controlled from positive volume flow values to zero. The upper limit for the adjustable positive volume flow values constitutes the maximum volume flow of the second pump unit. It is also particularly advantageous if the variably adjustable volume flow of the second pump unit 3 can be adjusted or controlled from positive volume flow values, that is to say from the maximum volume flow, to even negative volume flow values, with the volume flow being reversed. Here, the second pump unit 3 is designed to be adjustable such that a positive volume flow value can be set such that a volume flow can be controlled in one direction through the pump, wherein, in another operating state, negative volume flow values can also be controlled. This entails a volume flow reversal, such that, proceeding from a positive volume flow between a fluid inlet and a fluid outlet, these can, in the event of a volume flow reversal, be reversed in terms of their function to become a fluid outlet and a fluid inlet respectively, such that in the case of negative volume flow values, the fluid volume can be delivered in the opposite direction through the pump unit.

FIG. 1 also shows that the first pump unit 2 and the second pump unit 3 have in each case one inlet duct 6, 7 and one outlet duct 8, 9, which are connected to one another in each case. Accordingly, the inlet duct 6 of the first pump unit 2 is connected to the inlet duct 7 of the second pump unit 3. Also, the outlet duct 8 of the first pump unit 2 is connected to the outlet duct 9 of the second pump unit 3. Here, the inlet duct 7 of the second pump unit 3 becomes the outlet duct in the event of a volume flow reversal, and at the same time the outlet duct 9 of the second pump unit 3 becomes the inlet duct in the event of a volume flow reversal, such that in the event of a volume flow reversal, the inlet duct 6 of the first pump unit 2 is connected to the inlet duct 7, which then acts as an outlet duct, of the second pump unit 3, and the outlet duct 8 of the first pump unit 2 is connected to the duct 9, which then acts as an inlet duct, of the second pump unit 3.

This interconnection has the effect that the first pump unit 2 pumps a constant volume flow from the fluid inlet 4 to the fluid outlet 5, while at the same time the second pump unit 3 provides its own contribution to the overall volume flow between the fluid inlet 4 and fluid outlet 5.

In a first operating mode of the second pump unit 3, the second pump unit 3 can generate a positive volume flow between the fluid inlet 4 and the fluid outlet 5, such that the overall volume flow between the fluid inlet 4 and the fluid outlet 5 is greater than the volume flow generated by the first pump unit.

In a further operating state of the second pump unit 3, the latter may be adjusted such that the volume flow delivered by the pump unit 3 is zero, such that the overall volume flow of the pump 1 corresponds to the volume flow of the first pump unit 2.

In a further operating state, the second pump unit 3 may also be controlled so as to generate a negative volume flow, with the volume flow being reversed, such that the second pump unit 3 pumps a volume flow from the outlet duct 9 to the inlet duct 7, such that the overall volume flow through the pump 1 between the fluid inlet 4 and the fluid outlet 5 is less than the volume flow generated by the first pump unit 2.

Figure 2:
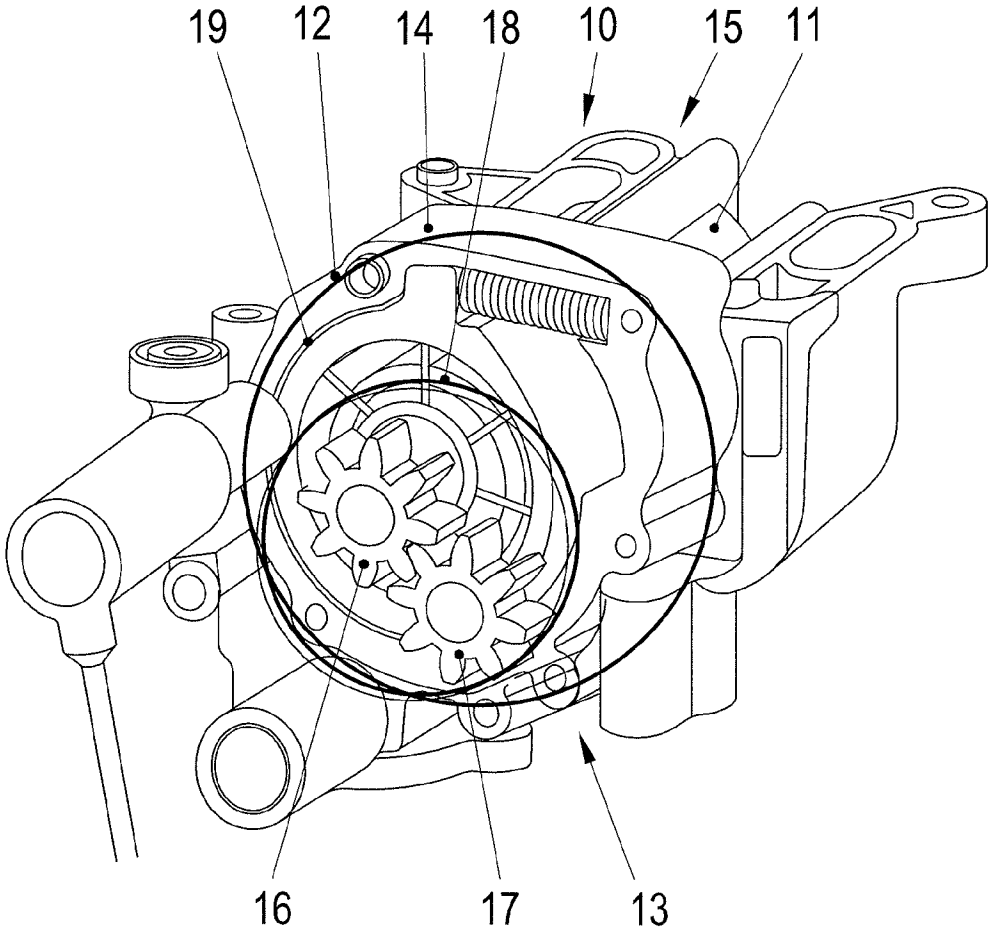
FIG. 2 is a schematic illustration of a pump according to the invention in a perspective view.

FIG. 2 shows, in a three-dimensional illustration, a pump 10 which has a first pump unit 11 and a second pump unit 12. The first pump unit 11 has a first housing part 13 which is illustrated in transparent form, wherein the second pump unit 12 has a second housing part 14. The housing parts 13 and 14 together, and if appropriate with other components of the housing, form the housing 15 of the pump 10.

The first housing part 13 houses the first pump unit 11, and the second housing part 14 houses the second pump unit 12. The first pump unit 11 is in the form of a gearwheel pump and is formed so as to exhibit a constant volume flow, wherein the second pump unit 12 is a vane-type pump which is variably adjustable in terms of volume flow.

It is indicated in FIG. 2 that the first pump unit 11 is an external gearwheel pump with two gearwheels 16, 17 which mesh with one another. Also schematically illustrated is the vane wheel 18 of the vane-type pump, which vane wheel is rotatably arranged in an adjustment element which is in the form of an annular element. The pump 1 of FIG. 1, and the pump 10 of FIG. 2, respectively, thus constitutes a pump which constitutes a fully variable vane-type pump as second pump unit with an external gearwheel pump as first pump unit connected in parallel, wherein the vane-type pump is formed such that it can deliver a negative volume flow, that is to say can operate in a reverse delivery direction.

If the pump is used as an oil delivery pump, the external gearwheel pump, as a pump that exhibits a constant volume flow, can deliver oil, wherein in an operating situation in which too much oil is delivered by the external gearwheel pump, the excess oil can be delivered back internally in the pump through the variable vane-type pump, this resulting in a lesser volume flow of the pump than that generated by the external gearwheel pump.

The volume flow limitation is realized by way of bypass control, which is more expedient from an energy aspect, and not by way of a cut-off action. The oil pressure can thus be regulated over the entire temperature range and rotational speed range of the pump.

The pump as per FIG. 2 is a pump which is of modular construction and which has a gearwheel pump and a vane-type pump in each case one first and one second housing part, wherein the pump units are arranged, spaced apart, axially one behind the other, such that it is also possible for a pump provided with closure covers and/or valve covers to be operated independently, or the stringing-together of other combinations of pump units can be made possible.

For example, a vane-type pump as per the second pump unit may either be operated as a pump on its own, or may serve, in combination with an external gearwheel pump, as a pump unit which, with the external gearwheel pump as a further pump unit, forms a pump that comprises said two pump units.

FIGS. 3 to 5 show and explain the mode of operation of the pump 10 in a full-delivery situation both by the first pump unit 11 and also by the second pump unit 12.

In FIG. 3, the second pump unit 12 is illustrated without its second housing part, such that only the pump element in the form of vane wheel 18 is visible. In FIG. 3, the vane wheel 18 is rotated clockwise by the drive element 20. Here, a fluid is delivered by the vane wheel 18 clockwise from the fluid inlet region 21 to the fluid outlet region 22, as per the arrows 23, 24 and 25, wherein this has added to it a fluid flow 26 from the first pump unit, such that the resulting overall fluid flow 27 through the fluid outlet 5 is accordingly the sum of the fluid flows of the two pump units 11, 12.

FIG. 4 shows a view of the first pump unit 11, for example gearwheel pump unit, in which, in the fluid inlet region 28, a fluid enters from the fluid inlet 4, and is delivered by the two gearwheels 30 and 31 to the fluid outlet region 29 as per the arrows 32 to 35, wherein at said fluid outlet region, the fluid flow 25 of the vane-type pump is added to the fluid flow of the gearwheel pump so as to generate an overall fluid flow 27.

The two gearwheels 30, 31 deliver in each case a partial volume flow, denoted by the arrows 33 and 34, from the fluid inlet region 28 to the fluid outlet region 29. Here, the fluid inlet regions 21, 28 of the gearwheel pump, that is to say of the first pump unit 11, and of the vane-type pump, that is to say of the second pump unit 12, are formed so as to communicate with one another in the housing 15. The same applies to the fluid outlet regions 22 and 29 of the first and second pump units 11, 12, which are likewise formed so as to communicate with one another in the housing 15.

FIG. 5 shows a second pump unit 12 of mirror-symmetrical form in relation to FIG. 3, wherein the shaft 36 serves as a drive element 20 which, in FIG. 5, is driven counterclockwise such that a volume is delivered counterclockwise. It can be seen that the vane wheel 18 is arranged in an adjustment element 19 such as an annular element, wherein the adjustment element 19 can be tilted by means of the axle 37 and the drive element 38, such that the vane wheel 18 can be adjusted with regard to its delivery direction and with regard to its delivery volume. Here, the drive element 38 is in the form of a spring, wherein the adjustment of the pump is realized by means of the exertion of pressure on the outer surface X of the adjustment element 19 counter to the force of the spring.

The tilting of the adjustment element 19 results not in the rotary axle of the vane wheel 18 being tilted, but merely in the volume flow directions being linked, such that, when the cylinder 39 of the vane wheel 18 makes contact with the adjustment element 19, no volume flow can be delivered past there, and therefore the volume flow is delivered in the opposite direction around the vane wheel 18.

Figure 8:
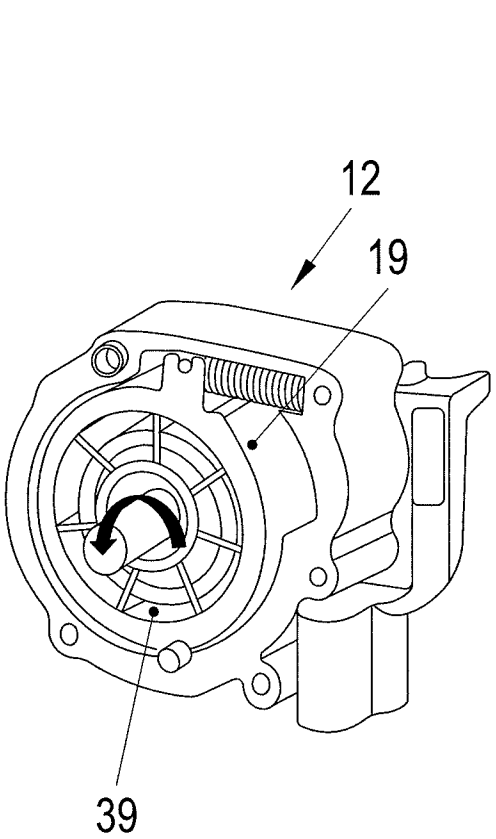
FIG. 8 is a schematic illustration of a pump according to the invention in a perspective partial view.
Figure 7:
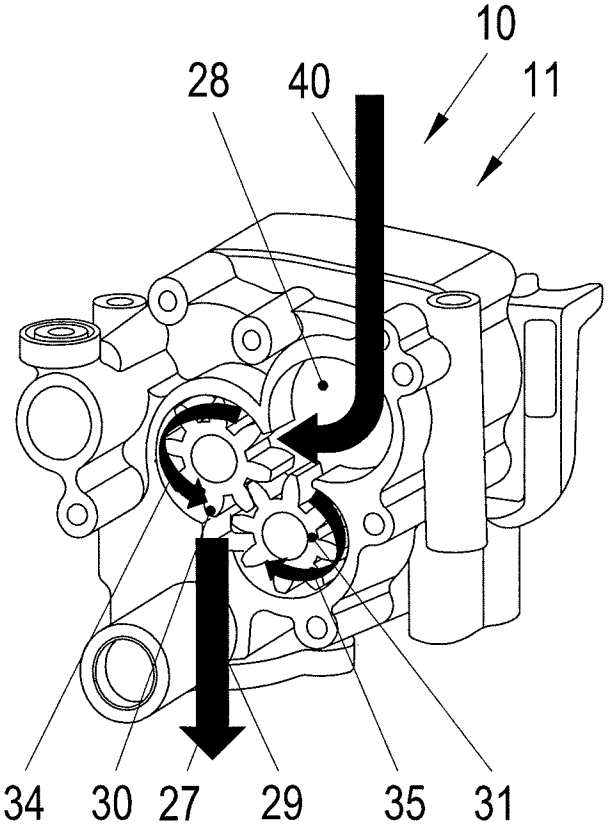
FIG. 7 is a schematic illustration of a pump according to the invention in a perspective partial view.
Figure 6:
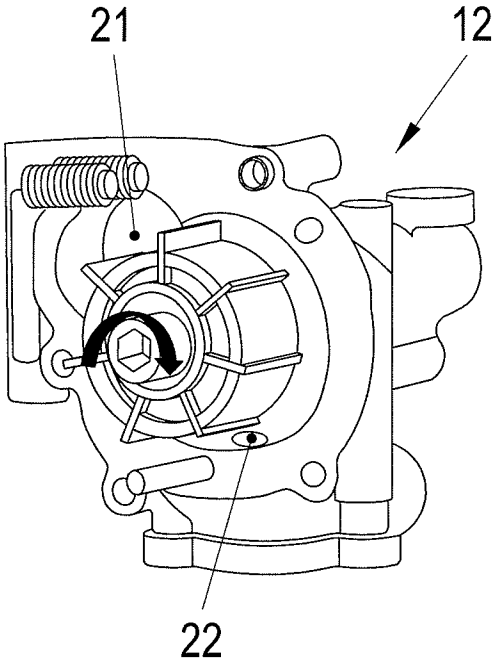
FIG. 6 is a schematic illustration of a pump according to the invention in a perspective partial view.

FIGS. 6 to 8 show the pump in a zero-delivery position of the second pump unit 12 with variable volume flow adjustment. The second pump unit 12 is set such that there is no resulting net volume flow between the fluid inlet region 21 and the fluid outlet region 22, such that the second pump unit 12 does not deliver a volume flow, that is to say a zero-delivery situation prevails.

The first pump unit 11 as per FIG. 7 delivers a volume flow similarly to the delivery in the description relating to FIG. 4. An inlet-side volume flow 40 is received in the fluid inlet region 28 and is split into the partial fluid flows 34 and 35, as per the arrows thus labeled, and is delivered by the gearwheels 30 and 31 to the fluid outlet region 29, wherein the overall volume flow 27 corresponds to the volume flow delivered by the first pump unit 11.

FIG. 8 shows the second pump unit 12 set such that the adjustment element 19 is in a central position, such that a fluid flow can be delivered in a circuit around the cylinder 39, such that no net volume flow is delivered.

Figure 11:
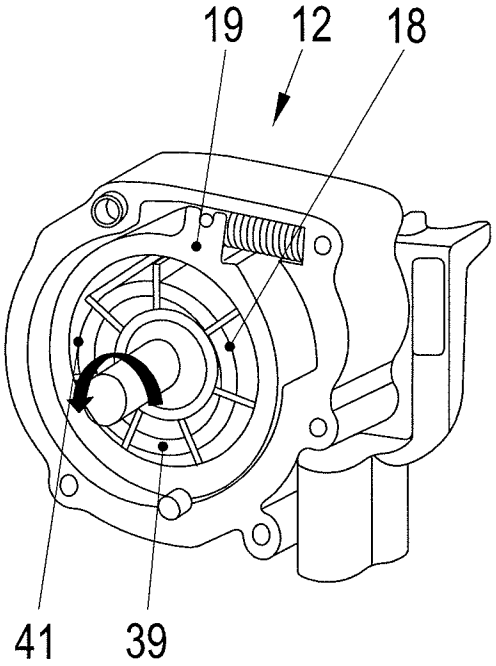
FIG. 11 is a schematic illustration of a pump according to the invention in a perspective partial view.
Figure 10:
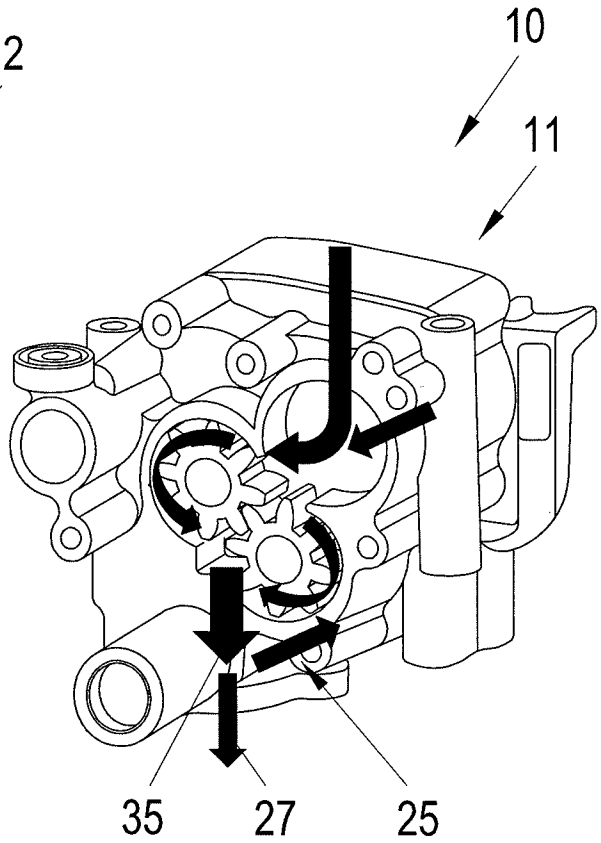
FIG. 10 is a schematic illustration of a pump according to the invention in a perspective partial view.
Figure 9:
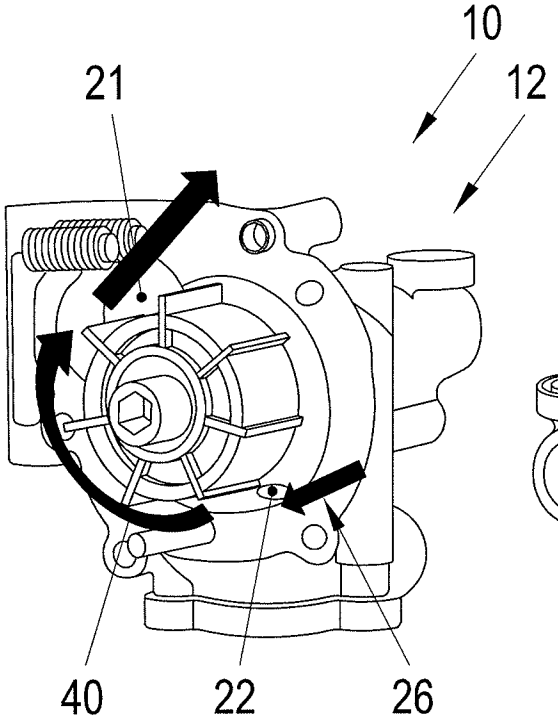
FIG. 9 is a schematic illustration of a pump according to the invention in a perspective partial view.

FIGS. 9 to 11 show an operating situation of the pump 10 with the two pump units 11 and 12, wherein it can be seen in FIG. 9 that the second pump unit 12 delivers a volume flow from the fluid outlet region 22 to the fluid inlet region 21, as per arrow 40, such that the fluid flow delivered, as per arrow 40, by the second pump unit is delivered in the opposite direction in relation to the volume flow delivered, as per arrow 24, by the second pump unit in FIG. 3. Thus, no further fluid flow is added to the volume flow of the first pump unit 26, there instead being branched off from said volume flow a volume flow that is delivered back in the direction of the fluid inlet. A fluid flow is thus drawn off.

FIG. 10 shows the first pump unit 11 as per the description of FIG. 4, it however being the case that the volume flow of the second pump unit 12, as per arrow 25, is not added to the volume flow as per arrow 35, the volume flow as per arrow 25 instead reducing the volume flow of the overall volume flow 27.

FIG. 11 shows the adjustment element 19 of the second pump unit 12 in the position in which said adjustment element 19 has been tilted fully to the right, such that the cylinder 39 of the vane wheel 18 makes contact with the inner wall of the adjustment element in the left-hand region 41, such that a volume flow is possible only clockwise in FIG. 11.

FIGS. 3 to 11 show the mode of operation of the pump 10, of the first pump unit 11 and of the second pump unit 12, wherein the fluid inlet 4 of the housing 15 forms in each case one fluid connection to the first and to the second pump unit 11, 12, wherein the fluid outlet 5 of the housing 15 also forms in each case one fluid connection to the first and to the second pump unit 11, 12. The two fluid connections from the first and from the second pump unit 11, 12 to the fluid inlet 4 and/or to the fluid outlet 5 are in fluid communication with one another such that a short-circuited fluid flow within the housing from the first pump unit 11 to the second pump unit 12 and/or from the second pump unit 12 to the first pump unit 11 is also possible. In this way, a volume flow that is delivered by the first pump unit 11 from the fluid inlet region 28 thereof to the fluid outlet region 29 thereof can be delivered back again within the pump housing 15 through the second pump unit 12, such that a volume flow can be delivered back into the inlet region 28 of the first pump unit 11 by the second pump unit 12. In this way, it is possible to realize a volume flow reduction in relation to the constant volume flow of the first pump unit 11.

Here, the first pump unit 11 has a fluid inlet region 28 and a fluid outlet region 29 which can be fed by means of, and/or provide a feed to, a fluid connection from the fluid inlet 4 and/or from the fluid outlet 5. Also, the second pump unit 12 has a first fluid inlet region 21 and a first fluid outlet region 22, wherein a second fluid outlet region 22 and fluid inlet region 21 constitute an inlet region or an outlet region, depending on the delivery direction of the pump unit 12, wherein the first fluid outlet region 29 and the first fluid inlet region 28, respectively, and the second fluid outlet region 22 and the second fluid inlet region 21 of the first pump unit 11 are fluidically connected to the corresponding regions of the second pump unit 12.

In FIGS. 1 to 11, the two pump units are preferably driven by a single drive element, such that one shaft drives both the vane wheel 18 of the second pump unit 12 and also the gearwheels 30, 31 of the first pump unit 11. Here, the shaft may be arranged, in sections, within the housing parts of the pump units 11, 12, wherein the respective shaft parts may be connected to one another by means of a positively locking connection. In this way, it is made possible for the pump units 11, 12 to be connected to one another in a variable manner, such that different pump units can be connected to one another on the basis of a modular principle.

As a drive, there may preferably be provided an electric motor or a hydraulic drive or a connection to a drive element of an internal combustion engine, such that the pump 10 may for example be driven by means of the belt drive or a chain of the internal combustion engine.

In an alternative embodiment, it is however also possible for each of the two pump units 11, 12 to be driven by a dedicated drive element, for example electric motor. This has the advantage that different rotational speeds of the drive elements can be made possible.

Figures 12, 13, 14:
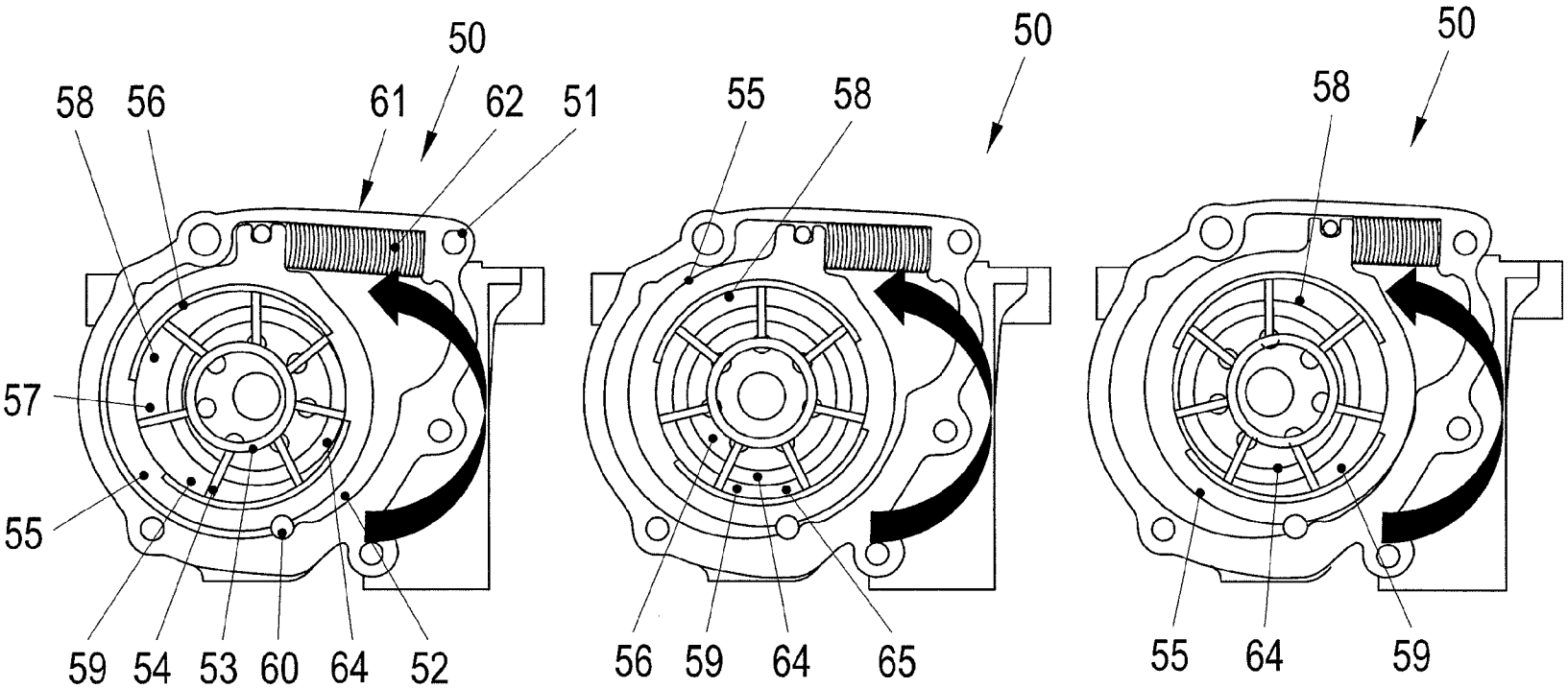
FIG. 12 is a schematic illustration of a pump according to the invention in a partial view.
FIG. 13 is a schematic illustration of a pump according to the invention in a partial view.
FIG. 14 is a schematic illustration of a pump according to the invention in a partial view.

FIGS. 12 to 14 show the mode of operation of the second pump unit 50 as a fully variable vane-type pump. FIG. 12 illustrates an operating position as per FIG. 5, that is to say an operating position in which the second pump unit 50 can generate a maximum volume flow between the fluid inlet and fluid outlet.

FIG. 13 shows an operating position of the second pump unit 50 as per an illustration of FIG. 8, in which no volume flow is generated by the second pump unit.

FIG. 14 shows an operating position of the second pump unit 50 as per FIG. 11, in which a negative volume flow can be generated, with the volume flow being reversed. The second pump unit 50 has a housing 51 with an interior 52 of the housing 51. The vane wheel 53 with the vanes 54 is arranged in the interior of the housing, wherein, once again, the adjustment element 55 is provided such that the vane wheel 53 with the vanes 54 is arranged radially within the hollow annular region 56 of the adjustment element. In the housing wall 57 situated behind this, there are provided openings 58, 59 which are of arcuate or kidney-shaped form and which extend in arcuate fashion over approximately one quarter to one third of the circumference of the adjustment element 19. Said openings 58, 59 are connected to the fluid inlet and fluid outlet 4, 5, respectively, and constitute a fluid inlet and fluid outlet region 21, 22, respectively, of the second pump unit 12.

The adjustment element 55, in the form of an annular element, is pivotable or tiltable in the housing by means of the axle 60, wherein a drive element 61 is provided which controls the annular element or adjustment element 19 with regard to its position, or with regard to its tilting, in the interior 52 of the housing 51. Here, the drive element 61 is a spring 62 that acts on the adjustment element, wherein the side surface X of the adjustment element 19 is acted on with pressure, and thus the adjustment element 19 is displaced counter to the spring force of the spring 62.

Alternatively, the drive element may also be realized in the form of gearwheel elements. Here, it is advantageously the case that a first gearwheel element is provided which can be rotated by a drive (not illustrated). The adjustment element, in the form of an annular element, also has a second gearwheel element with which the first gearwheel element meshes. Here, in a further alternative embodiment, the first gearwheel element is a worm that can be rotated by a drive, wherein the annular element or adjustment element has for example a second gearwheel element such as a worm wheel or the like, or in a simple embodiment an annular element, which engages into the toothing of the worm but is formed fixedly with the annular element or adjustment element, such that rotation of the worm results in tilting of the adjustment element.

It can be seen in FIG. 12 that the axle 60 and the drive element 61 in the form of spring 62 are arranged in each case on opposite sides of the adjustment element 55 which is in the form of an annular element, such that a simple design of the pump unit is ensured, and nevertheless the adjustment element 55 can be displaced in a simple manner.

FIG. 12 shows the adjustment element 55 situated in a position in which it has been tilted to the left to a maximum extent, such that the left-hand region of the adjustment element abuts against the housing and, at the same time, the right-hand region of the adjustment element lies laterally against the cylinder 64 of the vane wheel 53. In this way, a clockwise fluid flow between the cylinder 64 and the adjustment element 55 is prevented, such that only a counterclockwise fluid flow from the opening 59 to the opening 58 is possible. This has the effect that a fluid is delivered from the opening 59 to the opening 58, that is to say from a fluid inlet region to a fluid outlet region.

FIG. 13 shows the position of the adjustment element 55 in which the adjustment element is in a central setting and an annular gap 65 remains in each case between the cylinder 64 and the annular adjustment element 55, such that a circulating fluid flow under the action of the movement of the vane wheel 53 is made possible. This means that just as much fluid can be transported from the opening 59 to the opening 58 as can be transported from the opening 58 to the opening 59, such that no net fluid flow is delivered.

FIG. 14 shows the adjustment element 55 in a position in which said adjustment element 55 has been tilted to the right to a maximum extent, such that the annular adjustment element 55 bears by way of its left-hand region against the cylinder 64, such that only a clockwise fluid flow from the opening 58 to the opening 59 is possible, such that this constitutes a fluid-flow delivery in the opposite direction in relation to FIG. 12, that is to say constitutes a fluid reversal, with a negative volume flow.

Figures 15, 16, 17, 18:
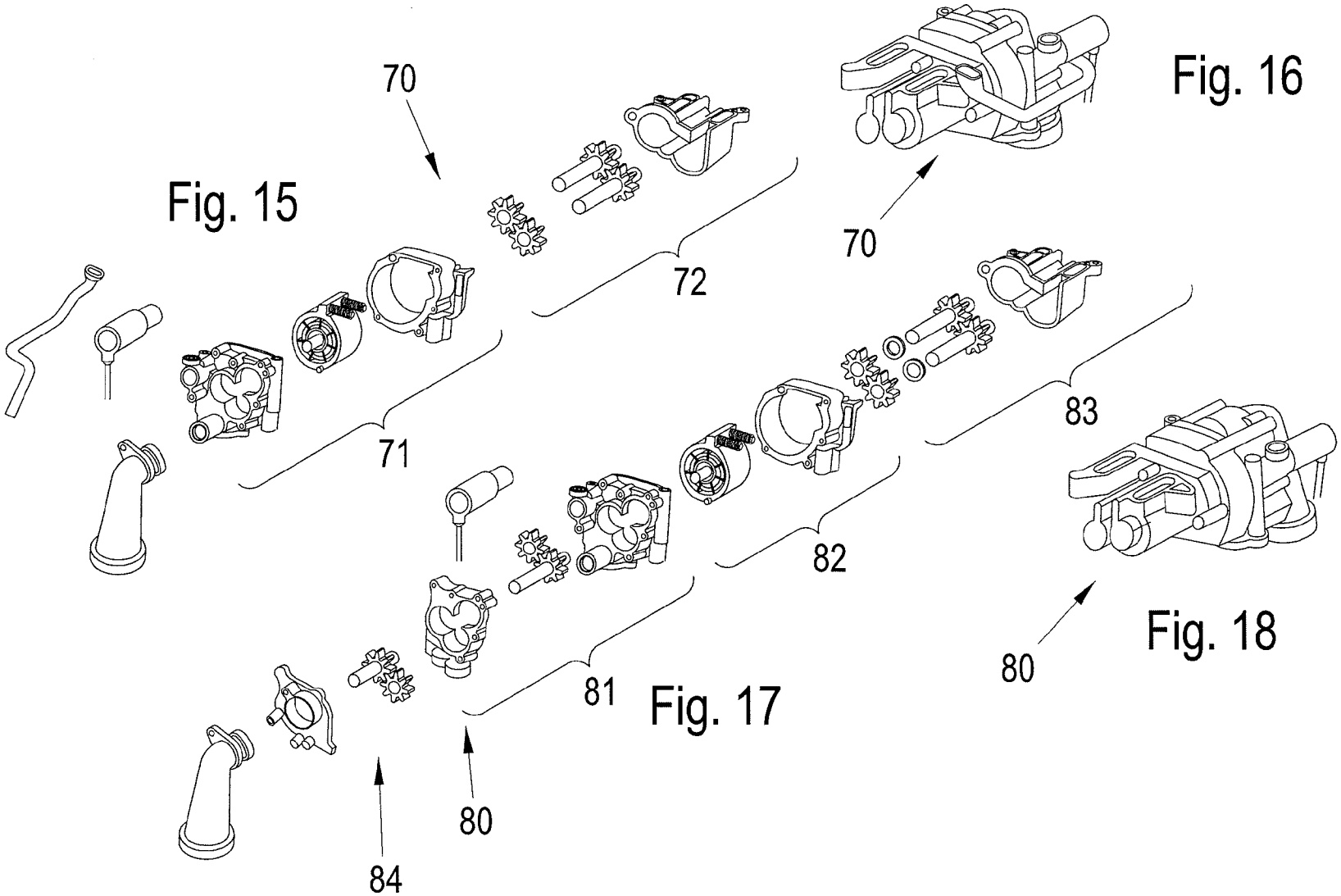
FIG. 15 is a schematic illustration of a pump according to the invention in an exploded illustration.
FIG. 16 is a schematic illustration of a pump according to the invention in a perspective view.
FIG. 17 is a schematic illustration of a pump according to the invention in an exploded illustration.
FIG. 18 is a schematic illustration of a pump according to the invention in a perspective view.

FIG. 15 shows a pump 70 in an exploded illustration, wherein FIG. 16 illustrates the pump 70 in an assembled state. The pump 70 is composed in this case of a first pump unit 71 and of a valve unit 72 which are arranged adjacent to one another in an axial direction.

FIG. 17 shows a pump 80 in an exploded illustration, wherein FIG. 18 illustrates the pump 80 in assembled form. The pump 80 is composed of a first pump unit 81 and of a second pump unit 82 and of a valve unit 83.

The first pump unit 71 of the pump 70 constitutes, within the latter, a variable vane-type pump. The first pump unit of the pump 80 constitutes a pump that exhibits a constant volume flow in the form of a gearwheel pump, in particular external gearwheel pump, wherein the second pump unit 82 constitutes a fully variable vane-type pump. The elements of the pump 70 may also be used in the case of the pump 80, wherein, in the case of the pump 80, the gearwheel pump 81 was supplemented not only by the fully variable vane-type pump 82 but also by a further pump 84 which provides a feed to a further circuit.

FIGS. 15 to 18 thus show that a pump 70, 80 of modular construction can be assembled in various combinations in order to be able to obtain an optimum configuration for the respective application.

Figure 19:
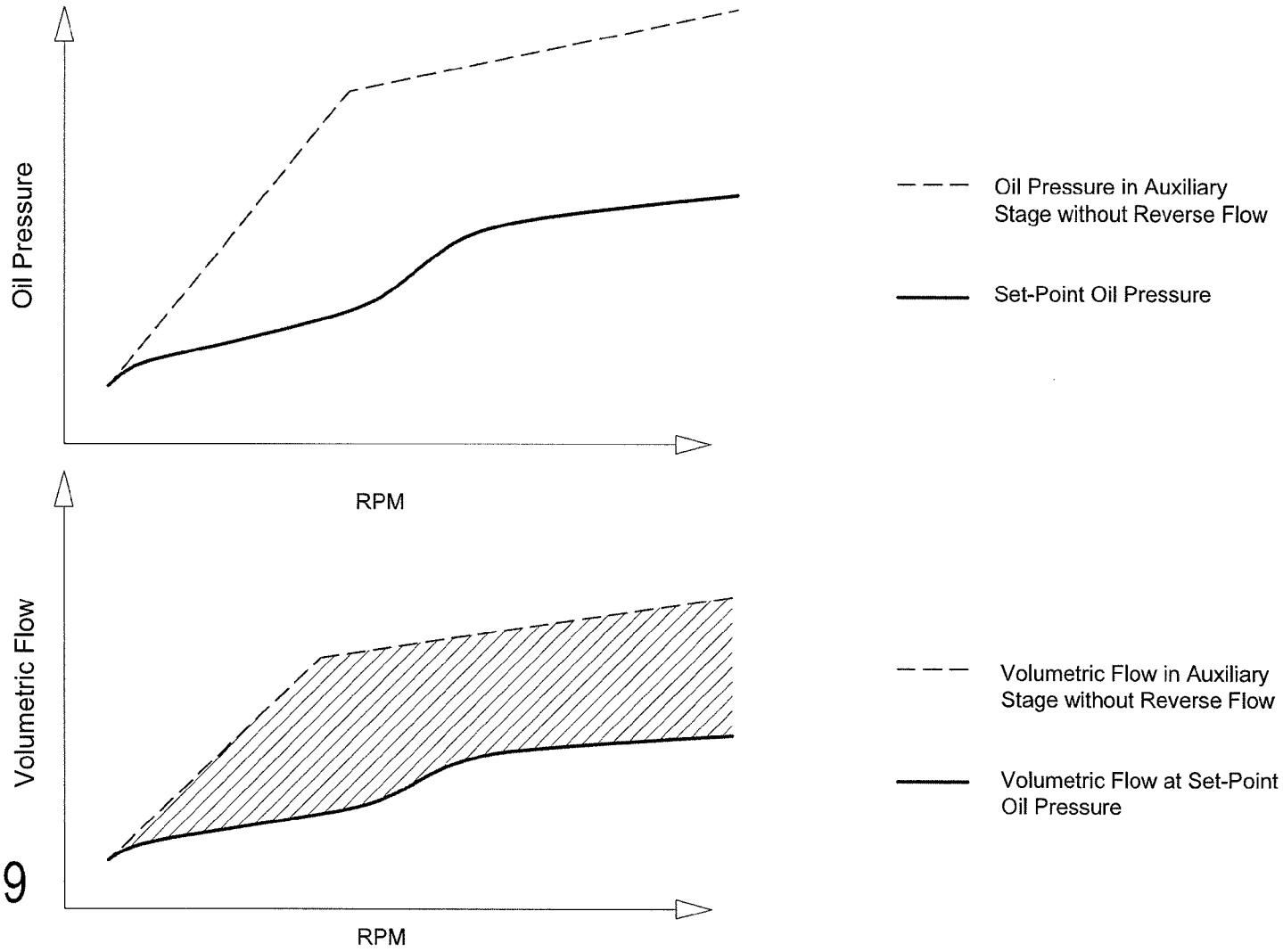
FIG. 19 shows two diagrams.

FIG. 19 shows two diagrams, wherein the oil pressure is illustrated as a function of rotational speed in the upper diagram, and the volume flow is illustrated as a function of rotational speed in the lower diagram. In the upper curve, the solid line indicates the setpoint oil pressure, wherein the dashed line illustrates the oil pressure of the auxiliary stage without reverse flow in the internal circuit of the pump. By means of reverse flow, the oil pressure falls from the dashed line to the solid line.

In the lower diagram, the delivery volume at setpoint oil pressure is illustrated by the solid curve, wherein again, the dashed line illustrates the volume flow of the auxiliary stage without reverse flow. The difference between the two curves, that is to say the area between the two curves, represents the oil quantity or fluid quantity delivered back.

Figure 20:
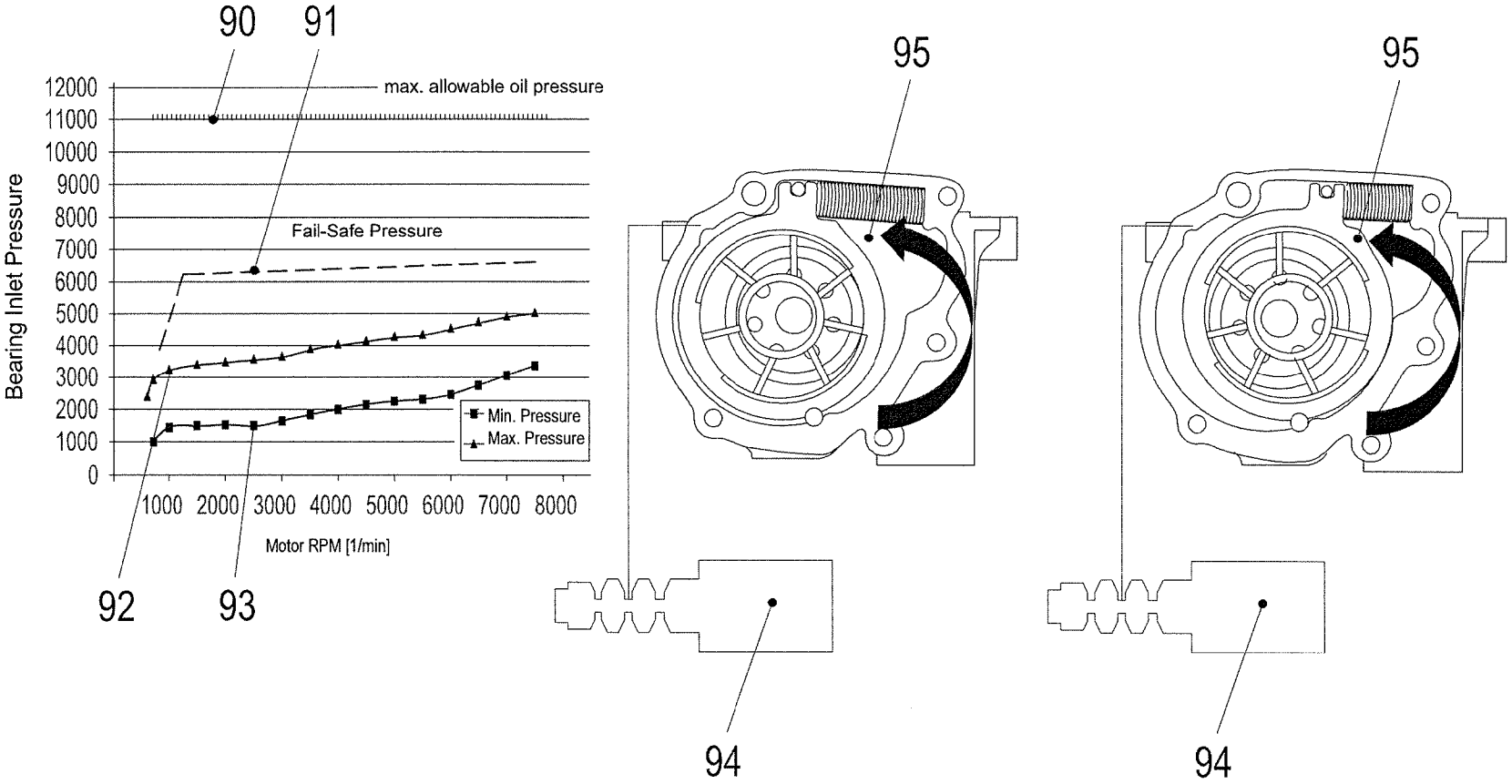
FIG. 20 shows a diagram and two views of a pump for explanation of the invention.

FIG. 20 shows a diagram of the bearing inlet pressure as a function of the rotational speed of the engine, wherein different curves are illustrated. The upper curve 90 represents the admissible overall pressure, the curve 91 represents a pressure for a so-called fail-safe operating state, wherein the curves 92 and 93 represent the minimum pressure and the maximum pressure.

The figures arranged adjacent thereto show that a control valve 94 can, by means of a continuously variable supply of electrical current to said control valve, regulate the pump unit 95 between a minimum and a maximum pressure in order to be able to set the pressure in continuously variable fashion between the pressure of the curve 93, as minimum pressure, and the pressure of the curve 92, as maximum pressure.

In the case of the pump, it is advantageous for the pump unit that provides a constant delivery action to be an oil pump, the delivery volume of which is configured for hot idle running, that is to say at hot oil temperatures and at low rotational speeds of the engine. With the pump unit that is arranged in parallel and that can be operated in a variable manner, the pump that is operated as an oil pump can also be adapted to engines with relatively high intake capacity. Since it is however the case in this situation that too much oil is then delivered during cold operation, this can be compensated by means of the "backward delivery" by the variable pump unit.

LIST OF REFERENCE NUMERALS

1 Pump
2 First pump unit
3 Second pump unit
4 Fluid inlet
5 Fluid outlet
6 Inlet duct
7 Inlet duct
8 Outlet duct
9 Outlet duct
10 Pump
11 First pump unit
12 Second pump unit
13 First housing part
14 Second housing part
15 Housing
16 Gearwheel
17 Gearwheel
18 Vane wheel
19 Adjustment element
20 Drive element
21 Fluid inlet region
22 Fluid outlet region
23 Arrow
24 Arrow
25 Arrow
26 Fluid flow
27 Overall fluid flow
28 Fluid inlet region
29 Fluid outlet region
30 Gearwheel
31 Gearwheel
32 Arrow
33 Arrow
34 Arrow
35 Arrow
36 Shaft
37 Axle
38 Drive element
39 Cylinder
40 Arrow
41 Region
50 Second pump unit
51 Housing
52 Interior
53 Vane wheel
54 Vane
55 Adjustment element
56 Annular region
57 Wall
58 Opening
59 Opening
60 Axle
61 Drive element
62 Spring
64 Cylinder
65 Annular gap
70 Pump
71 Pump unit
72 Valve unit
80 Pump

81 Pump unit
82 Pump unit
83 Valve unit
84 Pump
90 Curve
91 Curve
92 Curve
93 Curve
94 Control valve
95 Pump unit

The invention claimed is:

1. An internal combustion engine comprising:

an oil pump (1, 10) for lubricating parts of the internal combustion engine, the oil pump having a housing (15) with a single suction-side fluid inlet (4) and with a single pressure-side fluid outlet (5), the oil pump having a first pump unit (2, 11) and having a second pump unit (3, 12), the first pump unit (2, 11) being connected hydraulically in parallel with respect to the second pump unit (3, 12), wherein the first pump unit (2, 11) is a pump unit that exhibits a constant volume flow, wherein the second pump unit (3, 12) is a pump unit that exhibits variably adjustable volume flow for regulating a pressure of the oil delivered through the internal combustion engine as a function of a temperature of the oil, wherein the variably adjustable volume flow of the second pump unit (3, 12) can be adjusted from positive volume flow values to negative volume flow values, with the volume flow of the second pump unit (3, 12) being reversed, and wherein at a first temperature of the oil, the second pump unit delivers the oil in a forward direction towards the internal combustion engine, and at a second temperature of the oil that is lower than said first temperature, the second pump unit delivers at least a portion of the oil in a reverse direction in order to reduce a volume of oil being delivered to the internal combustion engine.

2. The internal combustion engine as claimed in claim 1, wherein the first pump unit (2, 11) and the second pump unit (3, 12) can be driven by at least one drive element (20).

3. The internal combustion engine as claimed in claim 2, wherein the first and the second pump unit can be driven by the same drive element (20).

4. The internal combustion engine as claimed in claim 1, wherein the first pump unit (2, 11) exhibits a constant volume flow in the case of a constant drive rotational speed of the drive element (20).

5. The internal combustion engine as claimed in claim 1, wherein the second pump unit (3, 12) exhibits a variably adjustable volume flow in the case of a constant drive rotational speed of the drive element (20).

6. The internal combustion engine claimed in claim 1, wherein the variably adjustable volume flow of the second pump unit (3, 12) can be adjusted from positive volume flow values to zero.

7. The internal combustion engine claimed in claim 1, wherein the first pump unit (2, 11) is an external gearwheel pump or an internal gearwheel pump.

8. The internal combustion engine as claimed in claim 1, wherein the second pump unit (3, 12) is a vane pump.

9. The internal combustion engine as claimed in claim 1, wherein the first pump unit (2, 11) and the second pump unit (3, 12) have in each case one inlet duct (6, 7) and one outlet duct (8, 9) that are connected to one another, wherein the inlet duct (7) of the second pump unit (3, 12) becomes the outlet duct in the event of a volume flow reversal, and wherein the outlet duct (9) of the second pump unit (3, 12) becomes the inlet duct in the event of a volume flow reversal, such that, in the event of a volume flow reversal, the inlet duct (6) of the first pump unit (2, 11) is connected to the outlet duct (9) of the second pump unit (3, 12) and the outlet duct (8) of the first pump unit (2, 11) is connected to the inlet duct (7) of the second pump unit (3, 12).

10. An internal combustion engine comprising:

an oil pump (1, 10) for lubricating parts of the internal combustion engine, the oil pump comprising a single modular housing (15) with a single suction-side fluid inlet (4) and with a single pressure-side fluid outlet (5), the modular housing accommodating a first pump unit (2, 11) and a second pump unit (3, 12), the first pump unit (2, 11) being connected hydraulically in parallel with respect to the second pump unit (3, 12), wherein the first pump unit (2, 11) is a pump unit that exhibits a constant volume flow, wherein the second pump unit (3, 12) is a pump unit that exhibits variably adjustable volume flow for regulating a pressure of the oil delivered through the internal combustion engine as a function of a temperature of the oil, wherein the first and the second pump unit can be driven by the same drive element (20), and wherein the variably adjustable volume flow of the second pump unit (3, 12) can be adjusted from positive volume flow values to negative volume flow values, with the volume flow being reversed, wherein at a first temperature of the oil, the second pump unit delivers the oil in a forward direction towards the internal combustion engine, and at a second temperature of the oil that is lower than said first temperature, the second pump unit delivers at least a portion of the oil in a reverse direction in order to reduce a volume of oil being delivered to the internal combustion engine.

11. An internal combustion engine comprising an oil pump (1, 10) for lubricating parts of the internal combustion engine, the oil pump having a housing (15) with a single suction-side fluid inlet (4) and with a single pressure-side fluid outlet (5), having a first pump unit (2, 11) and having a second pump unit (3, 12), the first pump unit (2, 11) being connected hydraulically in parallel with respect to the second pump unit (3, 12), wherein the first pump unit (2, 11) is a pump unit that exhibits a constant volume flow, wherein the second pump unit (3, 12) is a pump unit that exhibits variably adjustable volume flow for regulating a pressure of the oil delivered through the internal combustion engine as a function of a temperature of the oil, wherein the variably adjustable volume flow of the second pump unit (3, 12) can be adjusted from positive volume flow values to negative volume flow values, with the volume flow being reversed, while said first and second pump units are being driven at a constant rotational speed by a single drive element (20), wherein at a first temperature of the oil, the second pump unit delivers the oil in a forward direction towards the internal combustion engine, and at a second temperature of the oil that is lower than said first temperature, the second pump unit delivers at least a portion of the oil in a reverse direction in order to reduce a volume of oil being delivered to the internal combustion engine, wherein the first pump unit (2, 11) is a gearwheel pump, wherein the second pump unit (3, 12) is a vane pump, and wherein the first pump unit (2, 11) and the second pump unit (3, 12) have in each case one inlet duct (6, 7) and one outlet duct (8, 9) that are connected to one another, wherein the inlet duct (7) of the second pump unit (3, 12) becomes the outlet duct in the event of a volume flow reversal, and wherein the outlet duct (9) of the second pump unit (3, 12) becomes the inlet duct in the event of a volume flow reversal, such that, in the event of a volume flow reversal, the inlet duct (6) of the first pump unit (2, 11) is connected to the outlet duct (9) of the second pump unit (3, 12) and the outlet duct (8) of the first pump unit (2, 11) is connected to the inlet duct (7) of the second pump unit (3, 12).

* * * * *